United States Patent [19]

Mitamura et al.

[11] 4,362,401

[45] Dec. 7, 1982

[54] WATCHCASE

[75] Inventors: Gen Mitamura; Takao Eguchi; Yukio Nagami, all of Tokyo, Japan

[73] Assignee: Kabushiki Kaisha Daini Seikosha, Japan

[21] Appl. No.: 42,131

[22] Filed: May 24, 1979

[30] Foreign Application Priority Data

Sep. 8, 1978 [JP] Japan ..... 53-110881

[51] Int. Cl.[3] ..... G04B 37/00

[52] U.S. Cl. ..... 368/309; 368/291; 368/311

[58] Field of Search ..... 368/294, 276, 291, 309, 368/311

[56] References Cited

U.S. PATENT DOCUMENTS

| | | | |
|---|---|---|---|
| 2,737,009 | 3/1956 | Piquerez | 368/291 |
| 2,737,010 | 3/1956 | Piquerez | 368/291 |
| 3,714,775 | 2/1973 | Aoki | 58/90 R |
| 3,934,402 | 1/1976 | Fujimori | 368/291 |

FOREIGN PATENT DOCUMENTS

| | | | |
|---|---|---|---|
| 281805 | 1/1952 | Switzerland | 368/291 |
| 315164 | 7/1956 | Switzerland . | |

*Primary Examiner*—Bernard Roskoski

*Attorney, Agent, or Firm*—Robert E. Burns; Emmanuel J. Lobato; Bruce L. Adams

[57] ABSTRACT

A watchcase comprises a case body, a back cover connected to the back of the case body and a bezel connected to the top of the case body. A support member is connected to either the back cover or the bezel and comprises an outwardly extending flange, and oppositely disposed beads extending outwardly from the flange. The beads are configured to coact with recesses which are oppositely disposed in the inner surface of the case body so as to be received therein upon insertion of first one bead in its respective recess followed by the displacement of the support member relative to the case body so as to temporarily dispose the beads in extreme positions with respect to the recesses, and the beads are maintained in their respective recesses upon the return displacement of the support member so as to move the beads from their extreme positions. The beads are normally biased out of their extreme positions when inserted in the recesses. In this way, the bezel or the back cover can be removed from the case body without any deformation of the case body thereby avoiding the disadvantages which would otherwise occur due to deformation of the case body.

16 Claims, 8 Drawing Figures

PRIOR ART

PRIOR ART

PRIOR ART

PRIOR ART

PRIOR ART

WATCHCASE

BACKGROUND OF THE INVENTION

The present invention relates to a watchcase and more particularly to a non-round portable watchcase having a simple and rigid joint construction between the case body and a back cover or the case body and a bezel, as well as a simple water resistant construction in applying the above mentioned joint construction.

FIGS. 1*a–b,* show typical non-water resistant watch construction of the conventional type. FIG. 1(*a*) shows a basic non-water resistant watch construction wherein a glass 5 is adhered to a case body 1 with a face A by adhesives, and joint recesses 1*a* which join to a back cover 4 are provided inside an inner circumferential wall 1*c* of the case body 1. Numeral 2 is a support member which is respectively provided with a flange 2*b* which extends internally so as to hold a movement 7 at an upper inner diameter of the case body and projections 2*a* (referred to hereinafter as peripheral beads) at a side wall 2*f* thereof. The support member 2 is united in one body with the back cover 4 at a lower peripheral edge 2*g* by brazing and the like, or the support member 2 can be made in one body with the back cover 4 if desired.

The support member 2 of the non-water resistant watch construction shown in FIG. 1(*b*) is the same as that of FIG. 1(*a*) functionally and in order to increase the design variety, a bezel 6 is adhered to the case body 1 with an upper face B and a glass 5 is adhered to the bezel 6 with the face A. To obtain a water resistant watch construction, in FIG. 1(*c*) an annular stepped portion 1*b* is provided at the contact surface of the case body 1 and the back cover 4 in order to interpose a gasket 8 therebetween so as to prevent the penetration of water therethrough. A watch construction corresponding to that shown in FIG. 1(*c*) is described, for example, in U.S. Pat. No. 3,714,775. By way of another method to hold the gasket 8, the annular stepped portion 1*b* can be provided at the back cover 4. As for the above construction, since the gasket 8 must be compressed in the vertical direction (axial direction of the case) of the back cover 4 and the case body 1, a sufficient compressive force could not be obtained if the joining force of the peripheral beads was weak and the number of manufacturing process steps were increased by providing the stepped portion at the case body 1.

Further, since the gasket 8 was wound around the external periphery of the support member 2 when assembled, the gasket 8 couldn't be stably held and assembly was troublesome. Therefore, various kinds of devices have been conventionally contrived as shown in FIGS. 2*a–c* in order to hold the gasket stably. Namely, since the round back cover can be entirely machined by a lathe, a gasket holding recess E1 can be machined by a lathe all around the internal periphery of the gasket as shown in FIG. 2(*a*). This type prior art construction is shown in Swiss Pat. No. 315,164. On the contrary, if the back cover is not round, a gasket holding recess E2 is machined by a deformation cutting machine and a milling machine all around the external periphery of the support member as shown in FIG. 2(*b*), or a gasket holding recess E3 similar to the gasket holding recess E2 shown in FIG. 2(*b*) is machined only at the corner portions of a non-round support member which can be lathed circularly as shown in FIG. 2(*c*).

However, in the case of the non-round back cover, the number of manufacturing process steps increased and the gasket could not be completely held. Moreover, as mentioned above, conventionally a round annular bezel is fixed to the case body by joining the joint engaging portion machined by a lathe to the case body, while as for a non-round bezel, the bezel 6 is united to the case body 1 by adhesives, caulking and the like as shown in FIG. 1(*b*). Accordingly, since the bezel 6 is fixed to the case body 1 and cannot be joined thereto and removed therefrom, the movement 7 is assembled from the back cover side after removing the back cover 4. The construction shown in FIG. 1(*b*) has been applied widely to various designs and is highly regarded. However, since the movement is assembled from the back cover side, movements and dials having a larger external diameter than the back cover 4 cannot be assembled and resultantly watch design has been restricted.

As shown in FIGS. 3*a* and 3*b,* the conventional peripheral beads were deformed in various ways by utilizing the relative strength between the case body 1 and the support member 2. In the case wherein the plate thickness w of the case body 1 was comparatively thin as shown in FIG. 3(*a*), the case body was deformed extending in the external diametrical direction and the case body 1 and the support member 2 were joined as shown in FIG. 3(*a*), and in the case wherein the plate thickness w of the case body was thick and hard to be deformed, the support member 2 was deformed in the internal diametrical direction as indicated by an arrow and the case body 1 and the support member 2 were joined as shown in FIG. 3(*b*). However, the conventional joint construction taking advantage of the deformation in the diametrical direction is attended with various disadvantages.

In FIG. 3(*a*), since the case body 1 is extended in the external diametrical direction at the back cover side, an action to separate the glass holding face (A in FIG. 1) from the glass 5 is applied thereto by the principles of the lever. As the result, the glass 5 and the glass holding face are separated in the case when the adhesion thereof was weak, or the glass 5 was chipped off in the case when the adhesion thereof was strong and the glass 5 was thin and weak in strength.

In the case wherein the case body 1 is not deformed as shown in FIG. 3(*b*), the support member 2 is deformed in the internal diametrical direction, and the flange 2*b* falls and clamps the movement at the portion C in the drawing and thereby the movement 7 is badly stressed.

If the support member 2 is strengthened so as not to be deformed, the peripheral beads 2*a* chip off since both the case body 1 and the support member 2 can't be deformed, and as a result the required joint can't be ensured.

As illustrated above, the conventional joint construction taking advantage of the deformation in the diametrical direction seems to be very simple, actually however, very strict controls over the glass adhesion, the receiving diameter of the movement, the shape of the peripheral beads, the plate thickness of the case body and the support member and the like have been required.

SUMMARY OF THE INVENTION

It is an object of the present invention to provide a joint construction for a watchcase by which the back cover and the case body, or the bezel and the case body are deformed as little as possible when the back cover or the bezel are joined to the case body and to ensure the rigid joint construction. Further by applying the joint construction according to the present invention, the conventional various disadvantages are eliminated.

DETAILED DESCRIPTION OF THE INVENTION

Hereafter the present invention will be illustrated in conjunction with embodiments in FIGS. 4 to 8.

Figure 1A:
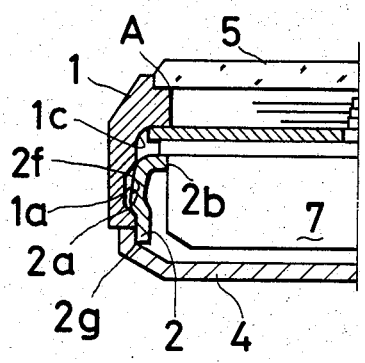
FIGS. 1(*a*), (*b*) and (*c*) are sectional views showing the conventional watch constructions, FIGS. 2(*a*) and (*b*) are sectional views showing conventional embodiments improving the gasket holding means, and FIG. 2(*c*) is a plan view of the back cover showing another embodiment, FIGS. 3(*a*) and (*b*) show the deformation of conventional peripheral beads, FIG. 4(*a*) is a sectional view showing an embodiment according to the present invention, FIGS. 4(*b*) and 4(*c*) are plan views showing the peripheral beads and the joint recesses at the joint portion of the embodiments of FIG. 4, in which FIG. 4(*b*) shows the state when the peripheral beads and the joint recesses are in equilibrium, and FIG. 4(*c*) shows the state when the peripheral beads and the joint recesses are placed to one side, FIGS. 5(*a*), 5(*b*), 5(*c*) and 5(*d*) show joint processes of the case body and the support member of FIG. 4*a*.
Figure 1B:
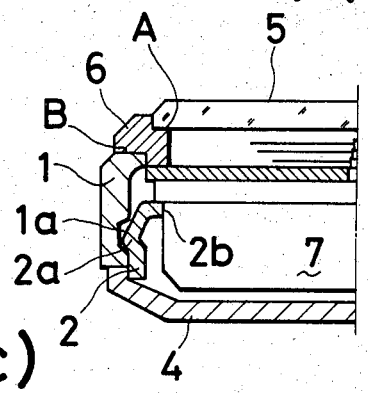
FIG. 1(b) PRIOR ART
Figure 1C:
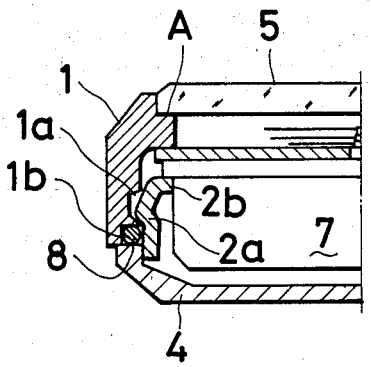
Figure 2A:
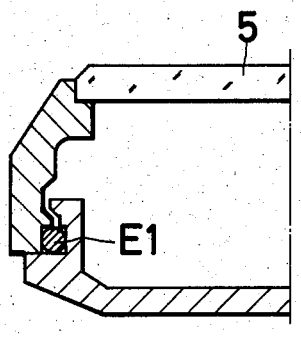
Figure 2B:
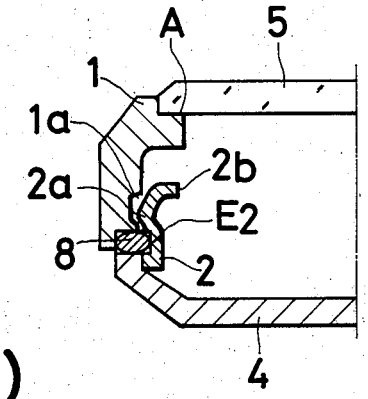
FIG. 2(b) PRIOR ART
Figure 2C:
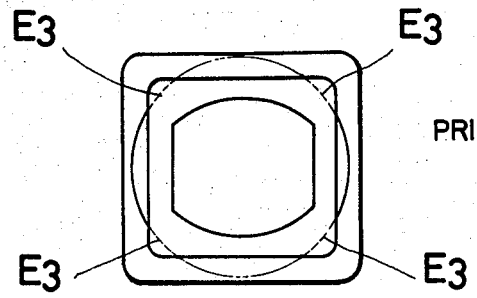
Figure 4A:
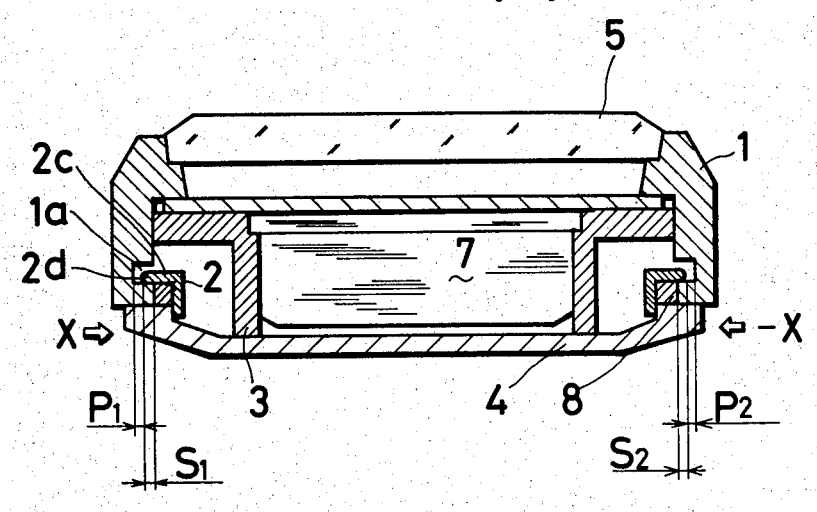
Figure 4B:
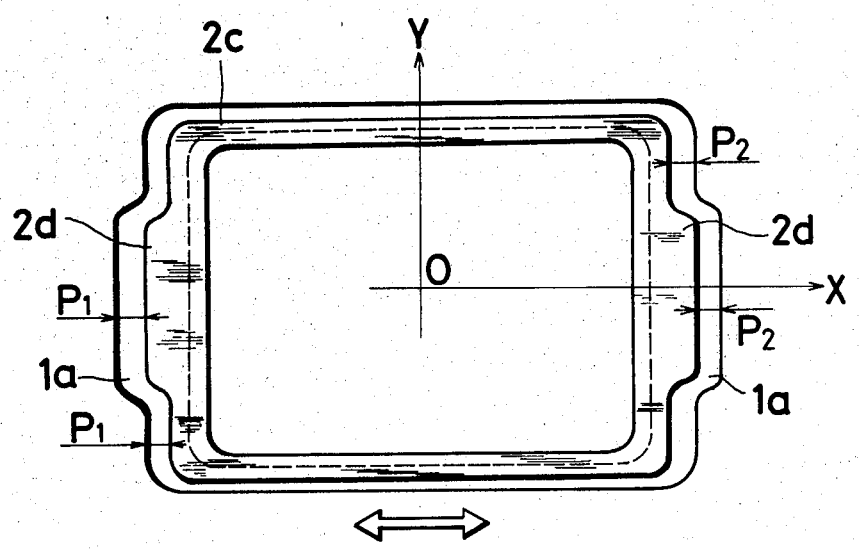
Figure 4C:
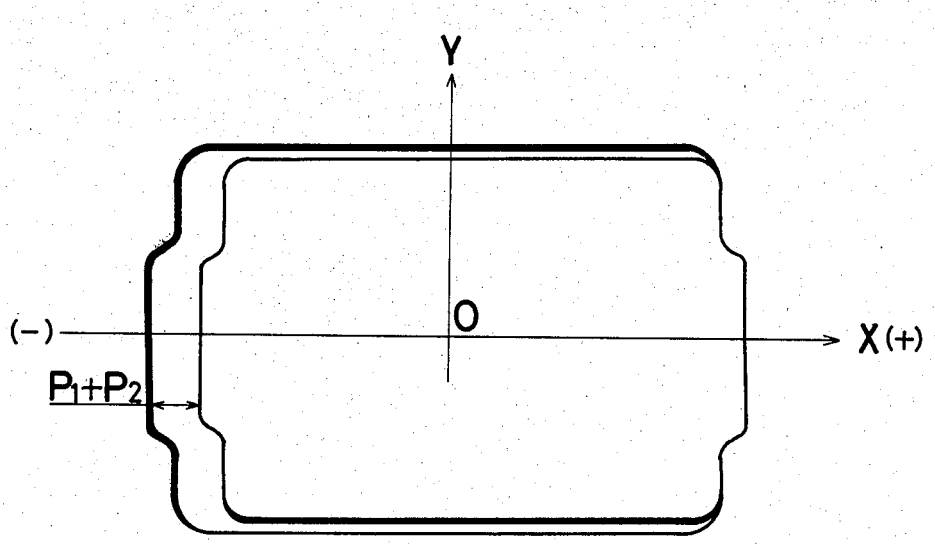
Figure 5A:
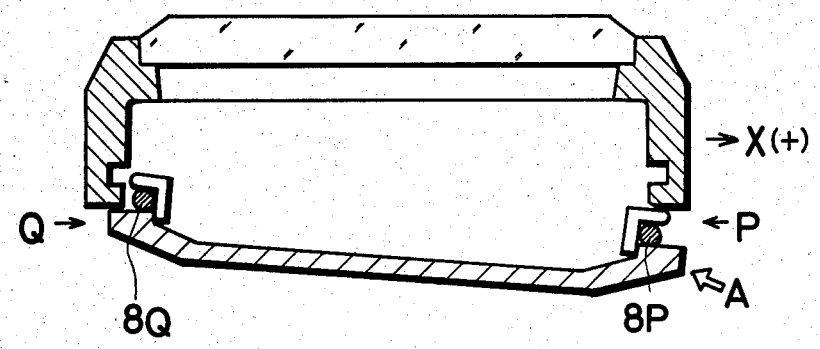
Figure 5B:
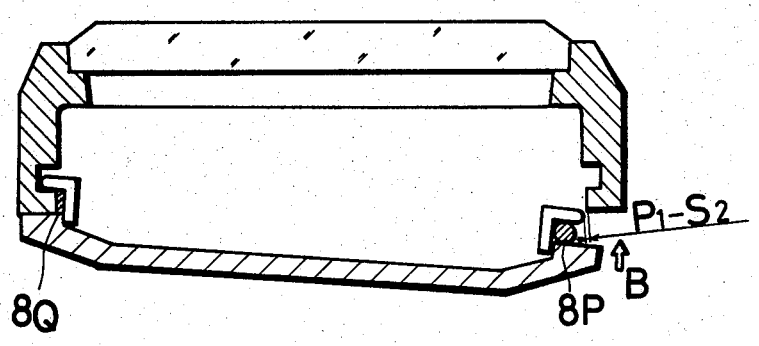
Figure 5C:
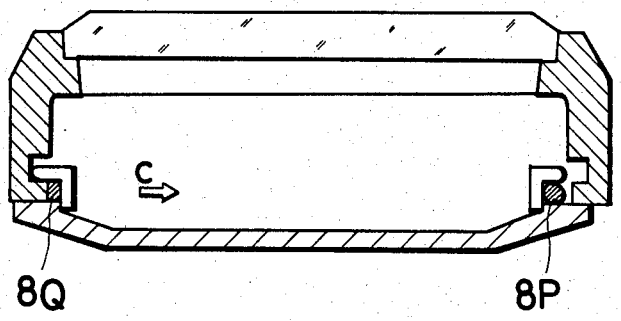
Figure 5D:
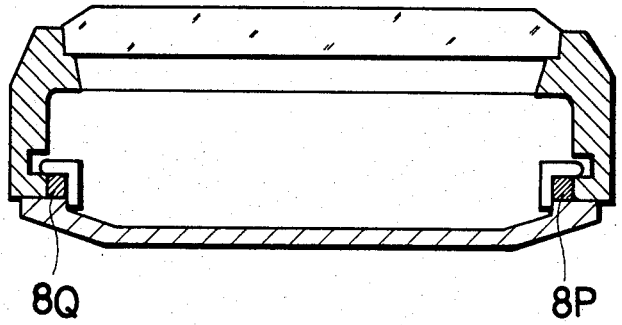

The embodiment in FIG. 4 is fundamentally the same as the conventional construction in FIG. 1 except for the support member 2. A case ring 3 in FIG. 4 is provided in order to hold the movement on the back cover 4 since the support member 2 according to the preset invention is not provided with the flange 2*b* which extends in the internal diametrical direction, so the case ring 3 does not directly relate to the joint portion of the present invention.

In FIGS. 4(*a*) and 4(*b*), numeral 2 is a support member provided with a flange 2*c* extending in the external diametrical direction at the upper end surface thereof and radial extensions of the flange 2*c* of the support member 2 serve as peripheral beads 2*d*. A case body 1 is provided with joint recesses 1*a* at the corresponding portion of the peripheral beads. As for a watchcase joined by means of the peripheral beads as shown in FIG. 1, generally the case body and the support member with the back cover are joined by deforming the case body or the support member, and lest the case body and the support member with the back cover should move in the direction of the joint axis, peripheral beads 2*a* of the support member and the joint recesses 1*a* of the case body are provided. However, as for the construction according to the present invention, as shown in the sectional view in the direction of the joint axis in FIG. 4(*a*), there is provided the joint recesses 1*a* deeper than the extent of the peripheral beads 2*d* of the support member 2. S1 and S2 are interferences where the case body and the support member are joined, P1 and P2 are movable clearances, and whichever is longer out of S1 and S2 is actually effective. Though S1 and S2 are ordinarily the same, it is possible to differentiate S1 and S2 intentionally in order to prevent the joint of the case body and the support member from shifting in one direction.

P1 and P2 are movable clearances decided by the balance of the peripheral beads and the joint recesses, or the balance of the external shape of the flange and the internal shape of the case body in the direction of the joint axis.

In FIG. 4(*a*) a deformable elastic member comprising the gasket 8 is interposed between the case body 1 and the back cover 4 and when the gasket 8 is removed therefrom as shown in FIG. 4(*b*), the joint can be moved in the direction of the joint axis X by P1 or P2. It is not necessary to count on the movement in the direction of the Y axis which meets at a right angle with the joint axis. The shifting length in the direction of the X axis is P2 and the shifting length in the direction of the −X axis is P1. The shifting length change according to the lengths of the interferences S1, S2 and the clearances P1, P2.

(1) In the case where $P1 \geqq S2$, if the back cover is moved in the direction of the −X axis, the interference is 0 and the joint is removed.

(2) In the case where $P1 < S2$, the effective interference is $(S2-P1)$.

(3) In the case where $P2 \geqq S1$, if the back cover is moved in the direction of the X axis, the interference is 0.

(4) In the case where $P2 < S1$, the effective interference is $(S1-P2)$.

If either P1 or P2 is 0, the joint cannot be moved respectively in the direction of the −X axis or the X axis. Namely, the joint can be removed without deforming the case body 1 and the support member 2 by satisfying the following relations of the movable clearances P1, P2 and the effective interferences S1, S2: $P1 \geqq S2$ or $P2 \geqq S1$. However, without interposing the gasket, the back cover easily moves and joint is removed.

Therefore, as shown in FIG. 4(*a*), an elastic member 8 having elastic stability (which also serves as a gasket) is interposed into a space between a "Γ" shaped flange, the back cover and the inner circumferential wall of the case body, and thereby a shift in the direction of the joint axis is restricted. Since the elastic material (the gasket 8) has a very large elastic deformability in comparison with metals, the peripheral beads 2*d* can be interposed and joined to the joint recesses 1*a* without deforming the case body 1 and the support member 2 by force. FIGS. 5*a–d* show the joining process of the case body and the support member under the condition that the elastic material (gasket 8) is interposed therebetween. In FIG. 5(*a*), the peripheral beads at the Q side of the back cover interposing therein the gasket 8 are joined to the corresponding joint recesses. Under the condition as it is, the peripheral beads cannot be completely joined to the joint recesses disturbed by the gasket 8Q. Then if the back cover at the P side is pushed in the direction of the −X axis as indicated by arrow A, the gasket 8Q at the Q side is pressed and there is a clearance $(P1-S2)$ at the P side. When the back cover is pushed up as indicated by arrow B, a joint condition is as shown in FIG. 5(*c*). When the external force in the direction of the −X axis is released, the back cover is restored in the direction of the X axis as indicated by an arrow C by the elastic stability accumulated inside the gasket 8Q. Finally, as shown in FIG. 5(*d*), the joint is fixed at the position wherein the stabilities of the gasket 8P at the P side and the gasket 8Q at the Q side are balanced.

Thus, by the joint method according to the present invention, the deformation corresponding to the interference is completely absorbed by the elastic material 8, and thereby the case body and the back cover are not deformed at all during removal or restoral of the back cover.

Another embodiment applying the principles of the present invention will now be referred to.

Figure 6:
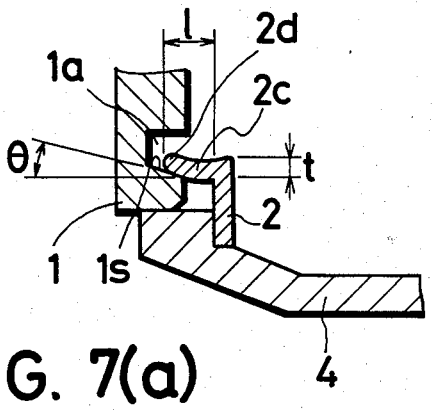
FIG. 6 is a fragmentary sectional view showing the joint portion of another embodiment improving the shape of the joint portion, FIGS. 7(*a*) and 7(*b*) are detailed sectional views of the joint portion shown in FIG. 4(*a*)

FIG. 6 is a fragmentary sectional view changing a partial shape of the joint portion of the case body and the back cover in FIG. 4*a*. The difference between the embodiment of FIG. 6 and that of FIG. 4*a* is as follows.

First, a slope making an angle $\theta$ with a contact surface of the case body and the back cover is provided at the effective surface 1*s* of the joint recess 1*a* of the case body. Second, the length l and the plate thickness t of the joint flange portion 2*c* are chosen so that the flange 2*c* can be elastically displaced in the axial direction of the watchcase (in the direction which meets at a right angle with the contact surface of the case body and the back cover) by setting the length l larger than the plate thickness t.

Figure 7A:
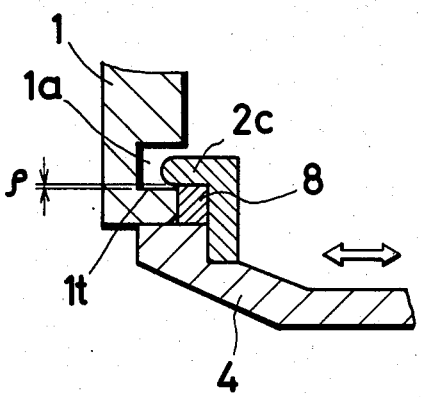
Figure 7B:
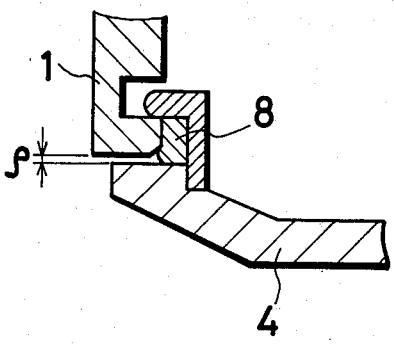

FIGS. 7*a* and 7*b* are fragmentary sectional views of the joint portion of the case body and the back cover in FIG. 4(*a*), in which, since the plate thickness t and the length l of the joint flange 2*c* are not set, in order to move the flange 2*c* in the direction of the joint axis (in the direction of an arrow in the drawing), strictly speaking, a clearance $\rho$ ($\rho>0$) is provided between the effective surface 1*t* of the joint flange 2*c* and the joint recesses 1*a* as shown in FIG. 7(*a*).

Upon completion of the watch, the clearance $\rho$ is provided between the contact surface of the case body 1 and the back cover 4 as shown in FIG. 7(*b*) since a movement is incorporated in the watch. A clearance $\rho$ of between 0.1 and 0.2 mm is out of the question though too wide clearance damages the water resistance function of the watch since the gasket 8 pours out therefrom. However, in view of the external appearance of a high class watch, the clearance is regarded as unpreferable. In FIG. 6, the clearance $\rho$ is 0 by providing the sloped angle $\theta$ at the joint surface 1S and setting the flange length l larger than the plate thickness t and contacting the peripheral beads 2*d* and the sloping surface 1*s* at a point of the sloping surface. In the present embodiment, an almost ideal joint is obtained by settling the sloped angle $\theta=15°$, flange length $l=0.4$ to 0.5 mm and the plate thickness $t=0.3$ to 0.35 mm.

Figure 8:
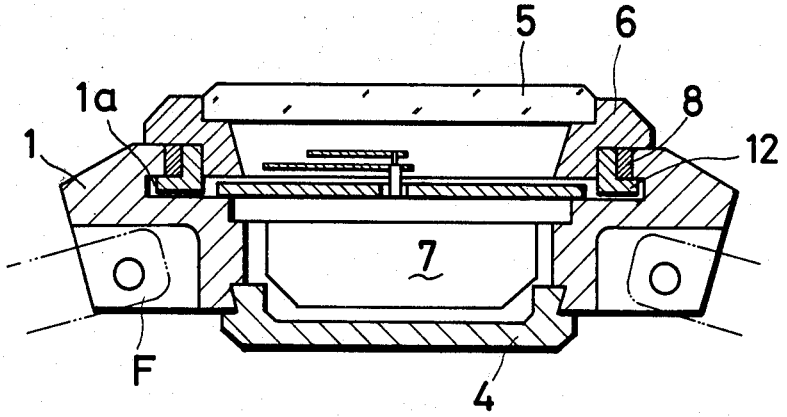
FIG. 8 is a sectional view showing another embodiment applying the joint construction of the present invention to the case body and the bezel.

FIG. 8 is another embodiment of the present invention in which a "Γ" shaped flange support member 12 is provided at the bezel 6. Glass 5 is adhered to the opening of the bezel 6 by a known adhering method such as adhesive, indentation and the like, while the "Γ" shaped flange support member is adhered to the joint portion of the case body and the bezel by the brazing method and the like. Naturally the flange support member 12 can be made in one body with the bezel 6. Numeral 8 is a gasket provided with the elastic stability which restricts the movement in the horizontal direction and prevents water leak. The case body 1 is provided with the joint recesses 1*a* at the portion corresponding to the peripheral beads of the "Γ" shaped flange member 12. The condition for designing the "Γ" shaped flange, the joint recesses, the clearance and the like in FIG. 8 are the same as that of the case body and the support member in FIG. 4. The working principle in the case where the bezel 6 is joined to and removed from the case body in FIG. 8 is the same as that of the back cover 4 and the case body 1 in FIG. 5.

Figure 3A:
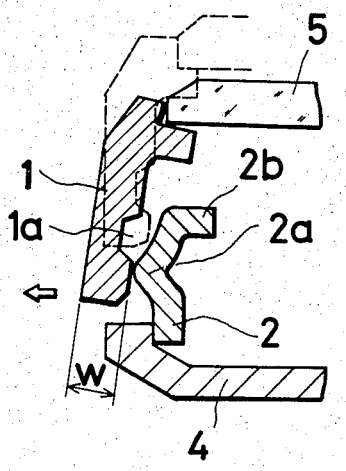
Figure 3B:
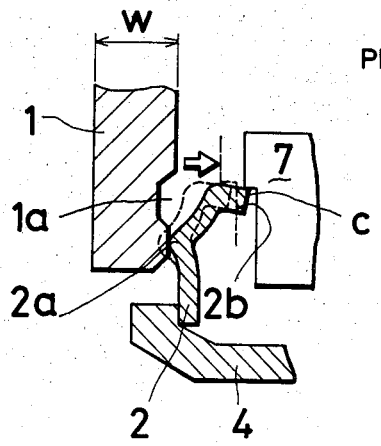
PRIOR ART FIG. 3(b)

The effect when the construction according to the present invention is applied to the bezel, is now explained. The back cover 4 in FIG. 4(*a*) is made of metal (occasionally made of plastic), which since the bezel 6 in FIG. 8 is provided with the glass 5 which is very fragile, the degree of deformation of the bezel 6 has a bad effect on the glass when the bezel 6 is joined to the case body 1. Namely, when the bezel is joined to the case body 1 by means of the conventional peripheral beads, relative deformations of the bezel are the same as the relative deformations between the case body and the back cover in FIG. 3 and thereby the glass adhering surface is occasionally separated and the glass is occasionally cracked.

According to the construction of the present embodiment, since the bezel 6 is not basically deformed, there is no risk that the glass 5 cracks in the case where the bezel is joined to or removed from the case body 1.

Accordingly, the watchcase according to the present invention has a number of advantages as follows.

As for quality, the joint construction has stabilized since the undesirable deformations of the case body, the back cover, the bezel and the like in the case of joining are removed and the water resistance has improved since the gasket 8 prevents the penetration of water.

As for design, because the case body, the back cover, the bezel and the like are not deformed during removal and replacement of the bezel or back cover, the thickness of the case body, the back cover, the bezel, the glass and the like are reduced as much as possible, and thereby design variety has increased.

As for the manufacturing process, the flange support member 2 can be worked by press work, and the peripheral bead portions 2*c* can be punched out together with the external shape, and thereby the shape of the beads and the like are stabilized.

As for cost, by making the flange support member separately, with the gasket interposing portions of the back cover, working the bezel and the like by press work, which is highly productive, thereby a reduction of cost can be achieved.

As illustrated, the watchcase according to the present invention is very efficient and widely applicable.

We claim:

1. A watchcase comprising: a case body having oppositely disposed internal recesses therein; a back cover; a support member fixedly connected to said back cover, said support member having an outwardly extending flange extending an outward radial direction of the watchcase from the upper end surface of the support member and having at least a pair of peripheral beads extending further outwardly from said flange and engageable with respective ones of said recesses; means defining clearances between the flange peripheral beads and the case body recesses to permit sufficient movement of the back cover relative to the case body in a diametrical direction of the watchcase to enable removal of the back cover from the case body without causing deformation of the case body, back cover or support member; and biasing means for resiliently biasing the back cover to a balanced position in which the flange peripheral beads engage with respective ones of the case body recesses to thereby removably join said back cover to said case body.

2. A watchcase as claimed in claim 1; wherein the biasing means comprises an elastic member interposed in the clearances in order to restrict the movement of the back cover relative to the case body and to prevent the penetration of water into the case body.

3. A watchcase as claimed in claim 1; wherein said recesses have a sloping surface at an angle of less than 45° with respect to the diametrical direction of the watchcase, and the length l of the peripheral beads of the support member being longer than the thickness t of the flange of the support member so that the peripheral beads can be displaced in the diametrical direction of the watchcase, and the peripheral beads of the flange contacting the sloping surface of the recesses of the case body when the support member joins the case body.

4. A watchcase comprising: a case body; a back cover; and connecting means removably connecting said back cover to said case body so as to permit removal of said back cover from said case body and replacement of said back cover onto said case body to define a watchcase, said connecting means comprising a support member connected to said back cover and having at opposite locations thereof radially outwardly extending flange portions, means defining recesses in said case body at opposite locations and movably receiving therein respective ones of said flange portions with sufficient clearance therebetween to enable a sufficient extent of movement of said back cover relative to said case body in a diametrical direction of the watchcase to permit removal and replacement of said back cover without deformation of said case body, back cover or support member, and a deformable elastic member interposed between said support member and case body and configured so as to undergo elastic deformation during removal and replacement of said back cover thereby preventing deformation of said case body, back cover and support member and having sufficient elasticity to urge said support member to a balanced position in which the support member flange portions engage the case body recesses upon replacement of said back cover thereby removably connecting said back cover to said case body.

5. A watchcase according to claim 4; wherein said support member has an annular shape and has a radially outward extending annular flange about its periphery, and wherein said flange portions comprise radial extensions of said flange at diametrically opposite locations thereof.

6. A watchcase according to claim 4; wherein said support member has an axial extent in the thickness direction of the watchcase less than one-half that of said case body.

7. A watchcase comprising: a case body having oppositely disposed internal recesses therein; a bezel; a support member fixedly connected to said bezel, said support member having an outwardly extending flange extending in an outward radial direction of the watchcase from the upper end surface of the support member and having at least a pair of peripheral beads extending further outwardly from said flange and engageable with respective ones of said recesses; means defining clearances between the flange peripheral beads and the case body recesses to permit sufficient movement of the bezel relative to the case body in a diametrical direction of the watchcase to enable removal of the bezel from the case body without causing deformation of the case body, bezel or support member; and biasing means for resiliently biasing the bezel to a balanced position in which the flange peripheral beads engage with respective ones of the case body recesses to thereby removably join said bezel to said case body.

8. A watchcase according to claim 7; wherein the biasing means comprises an elastic member interposed in the clearances in order to restrict the movement of the bezel relative to the case body and to prevent the penetration of water into the case body.

9. A watchcase comprising: a case body; a bezel; and connecting means removably connecting said bezel to said case body so as to permit removal of said bezel from said case body and replacement of said bezel onto said case body to define a watchcase, said connecting means comprising a support member connected to said bezel and having at opposite locations thereof outwardly extending flange portions, means defining recesses in said case body at opposite locations and movably receiving therein respective ones of said flange portions with sufficient clearance therebetween to enable a sufficient extent of movement of said support member relative to said case body in a diametrical direction of the watchcase to permit removal and replacement of said bezel without deformation of said case body, bezel or support member, and a deformable elastic member interposed between said support member and case body and configured so as to undergo elastic deformation during removal and replacement of said bezel thereby preventing deformation of said case body, bezel and support member and having sufficient elasticity to urge said support member to a balanced position in which the support member flange portions extend into the case body recesses upon replacement of said bezel thereby removably connecting said bezel to said case body.

10. A watchcase according to claim 9; wherein said support member has an annular shape and has an outwardly extending annular flange about its periphery, and wherein said flange portions comprise outward extensions of said flange at diametrically opposite locations thereof.

11. A watchcase according to claim 9; wherein said deformable elastic member has sufficient elasticity and shape to effect a fluidtight seal between said bezel and case body.

12. A watchcase according to any one of claims 9 to 11; wherein said bezel has a non-round shape.

13. A watchcase as claimed in any one of claims 1, 2 and 3; wherein said outwardly extending flange and peripheral beads have the same thickness in the thickness direction of the watchcase.

14. A watchcase as claimed in any one of claims 1, 2 and 3; wherein said back cover has a non-round shape.

15. A watchcase according to any one of claims 4–6; wherein the radially outwardly extending flange portions of said support member have a substantially uniform thickness in the thickness direction of the watchcase.

16. A watchcase according to any one of claims 4–6; wherein said back cover has a non-round shape.

* * * * *